US011312562B2

(12) United States Patent
Liu

(10) Patent No.: US 11,312,562 B2
(45) Date of Patent: Apr. 26, 2022

(54) HEAT INSULATING CONTAINER

(71) Applicant: FREE-FREE INDUSTRIAL CORP, Taipei (TW)

(72) Inventor: Sheng-Yu Liu, Taipei (TW)

(73) Assignee: FREE-FREE INDUSTRIAL CORP, Taipei (TW)

( * ) Notice: Subject to any disclaimer, the term of this patent is extended or adjusted under 35 U.S.C. 154(b) by 402 days.

(21) Appl. No.: 16/464,668

(22) PCT Filed: Mar. 29, 2019

(86) PCT No.: PCT/CN2019/080293
§ 371 (c)(1),
(2) Date: May 28, 2019

(87) PCT Pub. No.: WO2020/198901
PCT Pub. Date: Oct. 8, 2020

(65) Prior Publication Data

US 2021/0323751 A1 Oct. 21, 2021

(51) Int. Cl.

| | |
|---|---|
| ***B65D 21/02*** | (2006.01) |
| ***B65D 25/28*** | (2006.01) |
| ***B65D 81/34*** | (2006.01) |
| ***B65D 25/08*** | (2006.01) |
| ***B65D 25/22*** | (2006.01) |
| ***B65D 25/24*** | (2006.01) |
| ***B65D 45/32*** | (2006.01) |

(52) U.S. Cl.
CPC ..... *B65D 81/3453* (2013.01); *B65D 21/0209* (2013.01); *B65D 21/0233* (2013.01); *B65D 25/08* (2013.01); *B65D 25/22* (2013.01); *B65D 25/24* (2013.01); *B65D 25/28* (2013.01); *B65D 45/32* (2013.01)

(58) Field of Classification Search
CPC ..... B65D 45/22; B65D 2543/00564; B65D 21/0219; B65D 25/2805; B65D 25/2885; B65D 25/2897
See application file for complete search history.

(56) References Cited

U.S. PATENT DOCUMENTS 5,423,452 A * 6/1995 Tardif ..... A47J 43/0727 220/574
8,678,230 B2 * 3/2014 Smyers ..... B65D 45/22 220/784

* cited by examiner

*Primary Examiner* — Andrew T Kirsch
(74) *Attorney, Agent, or Firm* — Chun-Ming Shih; HDLS IPR Services

(57) ABSTRACT

A heat insulating container includes a bottom box and a surrounding wall surrounding the bottom box. A top portion of the bottom box is open and connected with the surrounding wall. An inner space of the surrounding wall is connected with an inner space of the bottom box, an opening is defined by a top edge of the surrounding wall, a handle portion is downward extended from an external surface of a junction between the bottom box and the surrounding wall, the handle portion and the bottom box are arranged at interval and a rubber strip is arranged wrapping the handle portion. Thereby the user is avoided from directly contacting with the bottom box. Therefore, the heat insulating container could be immediately taken out of a microwave oven after heater by the microwave oven.

10 Claims, 12 Drawing Sheets

HEAT INSULATING CONTAINER

BACKGROUND OF THE INVENTION

Technical Field

The present disclosure is related to a food container, and in particular to an anti-scald heat insulating container.

Description of Related Art

Generally, foods are contained in a container and placed in a microwave oven when the foods are heated by the microwave oven. The container cannot be heated by microwave because it contains no water, but heat still could be transferred to the entire container from the heated food. A user must wait until the container is cooled after the container is heated and then the container could be taken out. Therefore, it is inconvenient, and the foods are cooled while the container is cooled.

In views of this, in order to solve the above disadvantage, the present inventor studied related technology and provided a reasonable and effective solution in the present disclosure.

SUMMARY OF THE INVENTION

An anti-scald heat insulating container is provided in the present disclosure.

A heat insulating container having a bottom box and a surrounding wall surrounding the bottom box is provided in the present disclosure. A top portion of the bottom box is open and connected with the surrounding wall, an inner space of the surrounding wall is connected with an inner space of the bottom box, an opening is defined by a top edge of the surrounding wall, a handle portion is downward extended from an external surface of a junction between the bottom box and the surrounding wall, the handle portion and the bottom box are arranged at interval, and the handle portion is wrapped by a rubber strip.

According to the heat insulating container of the present disclosure, the opening is covered by a lid, a rubber strip is arranged on the lid, and the rubber strip is clamped between the lid and the surrounding wall and the opening is thereby sealed. A positioning recess is defined on an external surface of the lid, and the positioning recess is shaped corresponding to an external bottom surface of the bottom box for accommodating another bottom box. An annular groove is defined on a surface of the lid and a through hole is defined on the lid, the through hole is connected with the annular groove, the rubber strip is embedded in the annular groove and a portion of the rubber strip is embedded in the through hole.

According to the heat insulating container of the present disclosure, a plurality of snap-fits is arranged on an edge of the lid, the respective snap-fits buckle on an external surface of the surrounding wall. At least one barb for buckling with the snap-fits is arranged on the external surface of the surrounding wall. The barb is extended to surround the opening. According to the heat insulating container of the present disclosure, a recess is formed on an external bottom surface of the bottom box. A flange is outward extended from a junction between the bottom box and the surrounding wall, and the flange is connected between the bottom box and the surrounding wall. An inner box is accommodated in the surrounding wall and the inner box is stacked on the flange of the bottom box. The handle portion is extended from a lower edge of the surrounding wall.

According to the heat insulating container of the present disclosure, the handle portion of the surrounding wall and the bottom box are arranged at interval, and a space barrier is thereby defined to prevent a user from being scalded by directly contact with the bottom box.

BRIEF DESCRIPTION OF DRAWINGS

The present disclosure can be more fully understood by reading the following detailed description of the embodiment, with reference made to the accompanying drawings as follows.

DETAILED DESCRIPTION OF THE INVENTION

Figure 1:
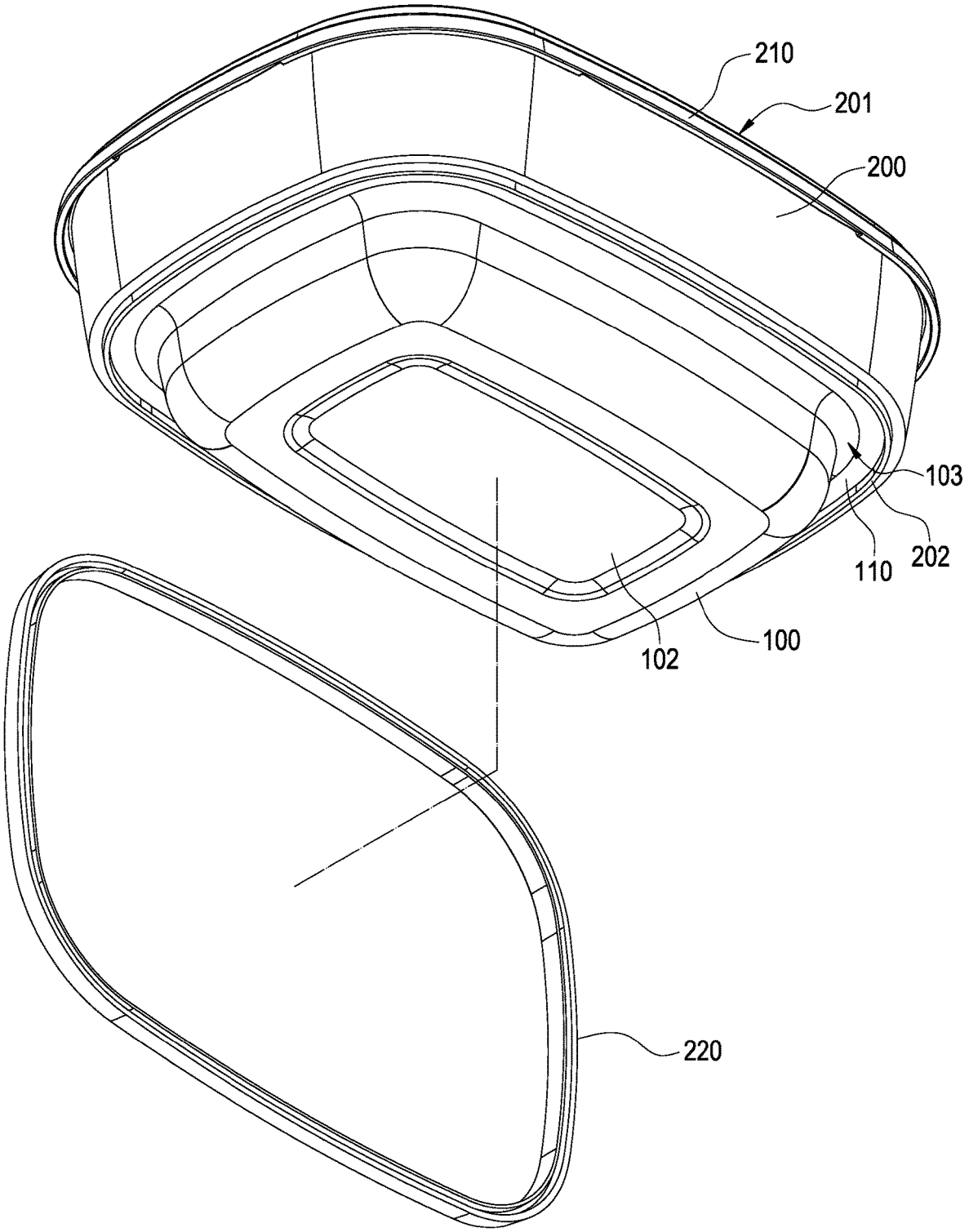
FIG. 1 is an exploded view showing the heat insulating container according to a preferred embodiment of the present disclosure.
Figure 2:
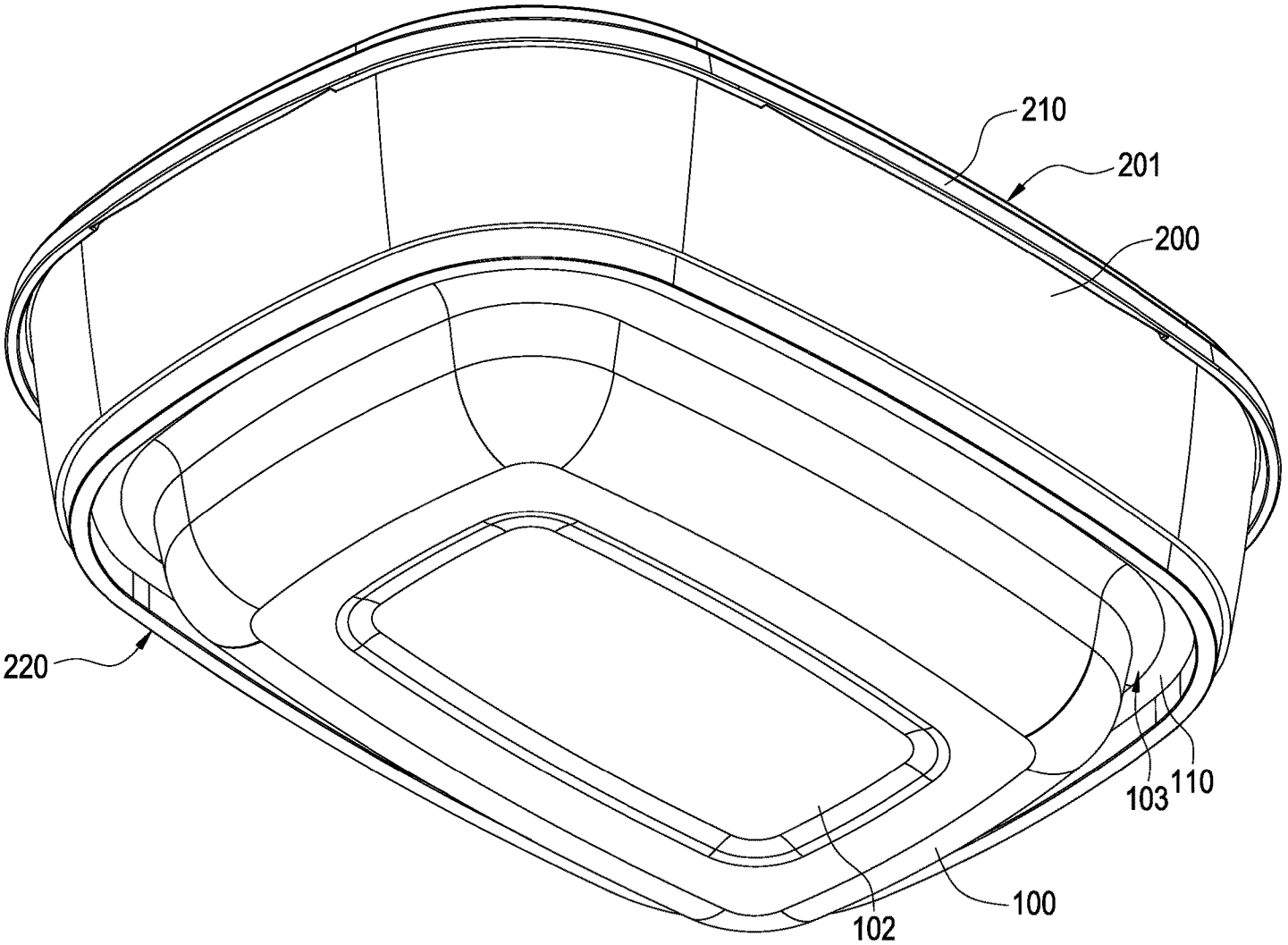
FIG. 2 is a perspective view showing the heat insulating container according to the preferred embodiment of the present disclosure.
Figure 3:
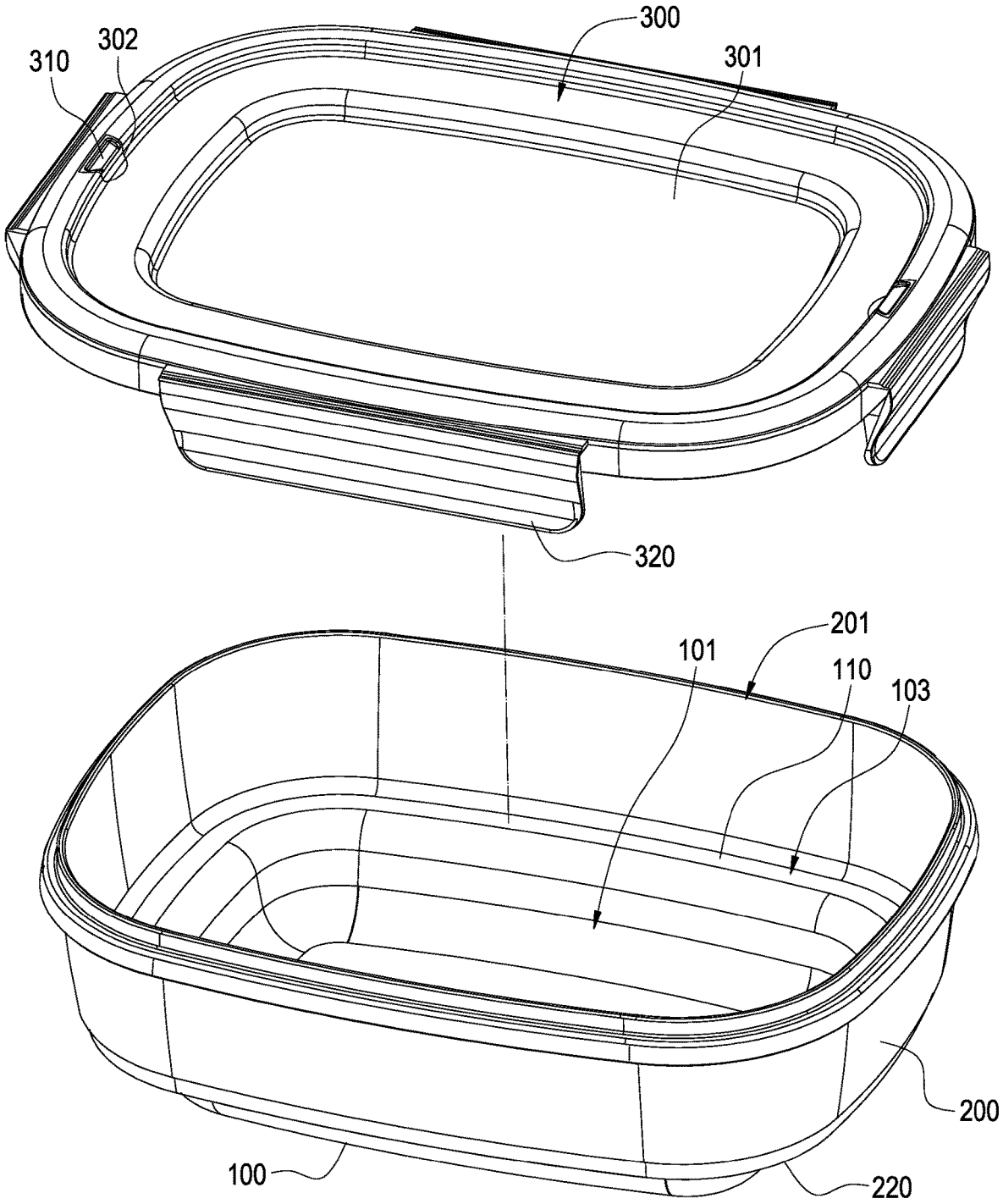
FIG. 3 is an exploded view showing the heat insulating container and a lid thereof according to the preferred embodiment of the present disclosure.
Figure 4:
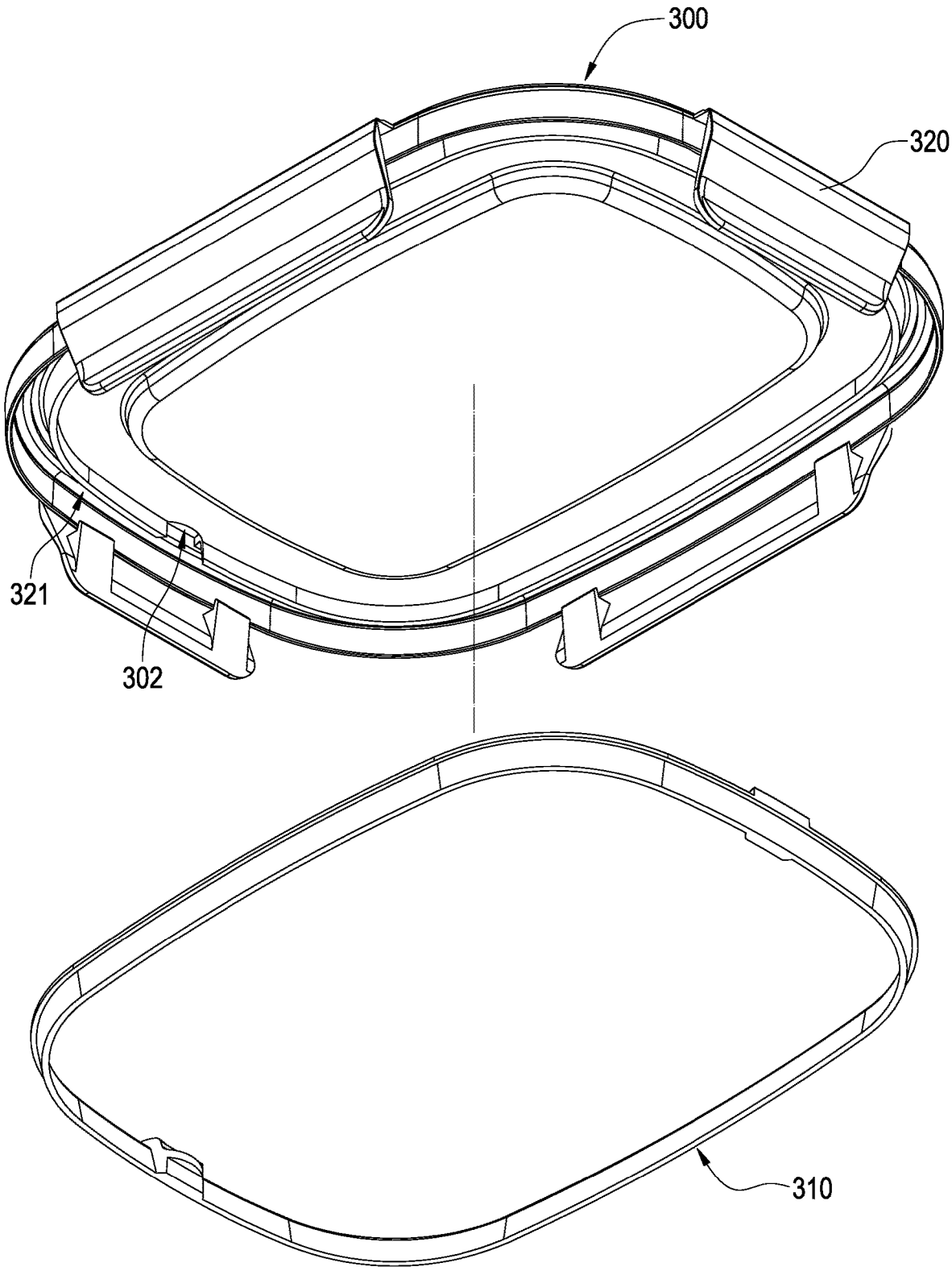
FIG. 4 is an exploded view showing the lid of the heat insulating container according to the preferred embodiment of the present disclosure.
Figure 5:
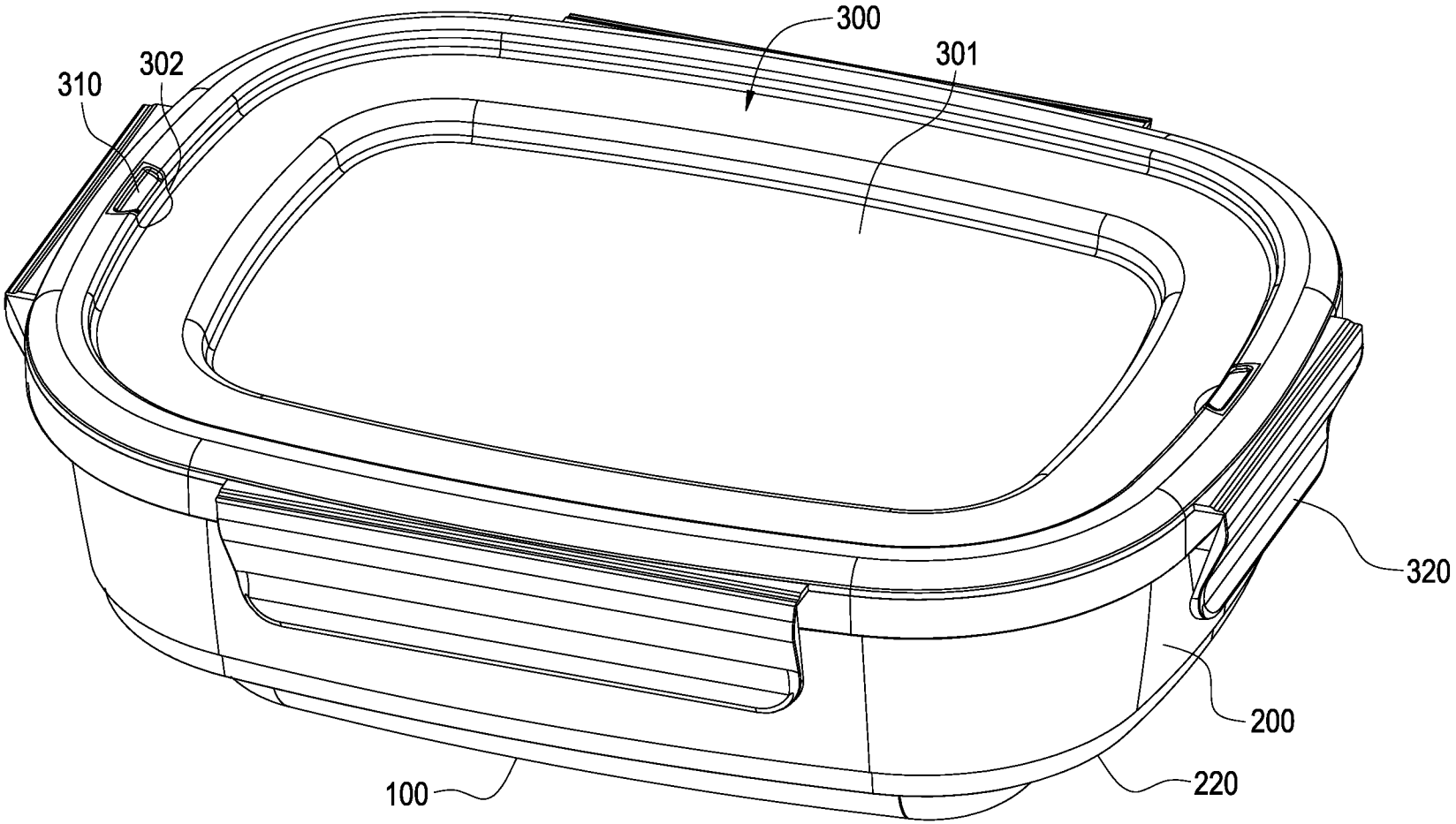
FIG. 5 is a perspective view showing the heat insulating container and the lid thereof according to the preferred embodiment of the present disclosure.
Figure 6:
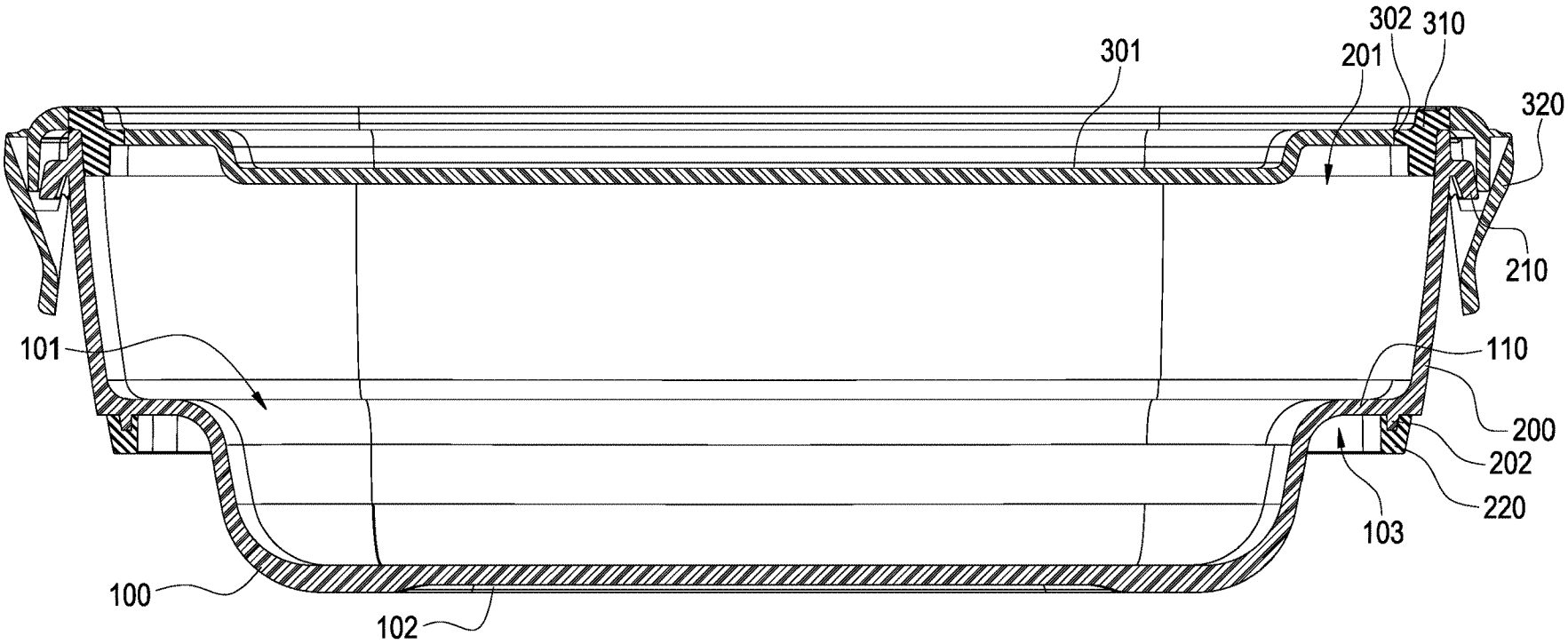
FIG. 6 is a cross-sectional view of the heat insulating container and the lid thereof according to the preferred embodiment of the present disclosure.

According to FIGS. 1 to 6, an anti-scald heat insulating container is provided in an embodiment of the present disclosure. The heat insulating container at least has a bottom box 100 and a surrounding wall 200. An opening 201 is enclosed by a top edge of the surrounding wall 200, and a handle portion 202 is downward extended from an external surface of a junction 103 between the bottom box 100 and the surrounding wall 200.

According to the present embodiment, the bottom box 100 is preferably a flat cubic, a top 101 of the bottom box 100 is open and connected with the surrounding wall 200. According to the present embodiment, a flange 110 is outward extended from the bottom box 100 at the junction 103 between the bottom box 100 and the surrounding wall 200. Specifically, the flange 110 outward protrudes from the top 101 of the bottom box 100, and the flange 110 is extended to surround the top 101 of the bottom box 100 and connected with the surrounding wall 200. However, scopes of the present disclosure should not be limited to the embodiment, the surrounding wall 200 could alternatively be an inverted cone directly connected with the top 101 of the bottom box 100.

Specifically, the surrounding wall 200 surrounds the top 101 of the bottom box 100, an external edge of the flange 110 is connected with and internal surface of the surrounding wall 200, an inner space of the surrounding wall 200 is thereby connected with an inner space of the bottom box 100 for accommodating foods therein. According to the present embodiment, the handle portion 202 is preferably downward extended from a lower edge of the surrounding wall 200. The handle portion 202 protrudes the flange 110, the handle portion 202 and the bottom box 100 are arranged at interval, and the handle portion 202 is wrapped by a rubber strip 220 for heat insulation.

According to the heat insulating container of the present disclosure, the handle portion 202 of the surrounding wall 200 and the bottom box 100 are arranged at interval to form a space barrier and to prevent the bottom box 100 from directly contacting with a user. Furthermore, the handle portion 202 is wrapped by the rubber strip 220 to prevent from scald when the user holds the handle portion 202. Moreover, the foods are usually not completely filled in the heat insulating container, and the top edge of the surrounding wall 200 is thereby prevented from contacting with the heated foods and is therefore not hot. Accordingly, the heat insulating container of the present disclosure could be immediately taken out of a microwave oven after being heated, because the user will not be scalded when handles the top edge of the surrounding wall 200 and the handle portion 202 heat insulating container.

The opening 201 could be covered by a lid 300, and detail structures of the lid 300 are described below. According to the present embodiment, the lid 300 is preferably a rectangular plate, the lid 300 is wrapped by a rubber strip 310, the rubber strip 310 is clamped between the lid 300 and the surrounding wall 200 and the opening 201 is thereby sealed. Furthermore, the rubber strip 310 could further block heat transfer between the lid 300 and the surrounding wall 200 for further heat insulation. Accordingly, when the opening 201 is covered by the lid 300, the user will not be scalded when handles the lid 300 and the handle portion 202 of the surrounding wall 200.

Specifically, an annular groove 321 is defined on a surface of the lid 300 and a through hole 302 is defined on the lid 300, the through hole 302 is connected to the annular groove 321, the rubber strip 310 is embedded in the annular groove 321 and a portion of the rubber strip 310 is embedded in the through hole 302. The annular groove 321 is shaped corresponding to the opening 201 on the top edge of the surrounding wall 200, the through hole 302 of the lid 300 could be an inlet channel for modeling the rubber strip 310. Thereby, a material could be injected into the annular groove 321 through the through hole 302 to form the rubber strip 310 in the annular groove 321.

A plurality of snap-fits 320 are arranged on an edge of the lid 300, the respective snap-fits 320 buckle on an external surface of the surrounding wall 200 to press the lid 300 on the opening 201 and thereby sealing the opening 201. At least one barb 210 for buckling with the snap-fits 320 is arranged on the external surface of the aforementioned surrounding wall 200 and adjacent to the opening 201. However, the type of the barb 210 should not be limited to the embodiment. For example, a single barb 210 could be arranged surrounding the opening 201, the respective snap-fits 320 are buckled with the barb 210. Alternatively, a plurality of barbs 210 corresponding to the respective snap-fits 320 could be arranged on the surrounding wall 200 and outside of the opening 201, and the respective snap-fits 320 are buckled with the respective corresponding barbs 210.

According to the heat insulating container of the present disclosure, a recess 102 is formed on an external bottom surface of the bottom box 100. When the heat insulating container is heated, the external bottom surface is separated from a plan where it is placed by the recess 102 and a gap is formed therebetween. Thereby, the external bottom surface the bottom box 100 is prevented from sticking with the plane caused by vapor generated while heating.

Figure 7:
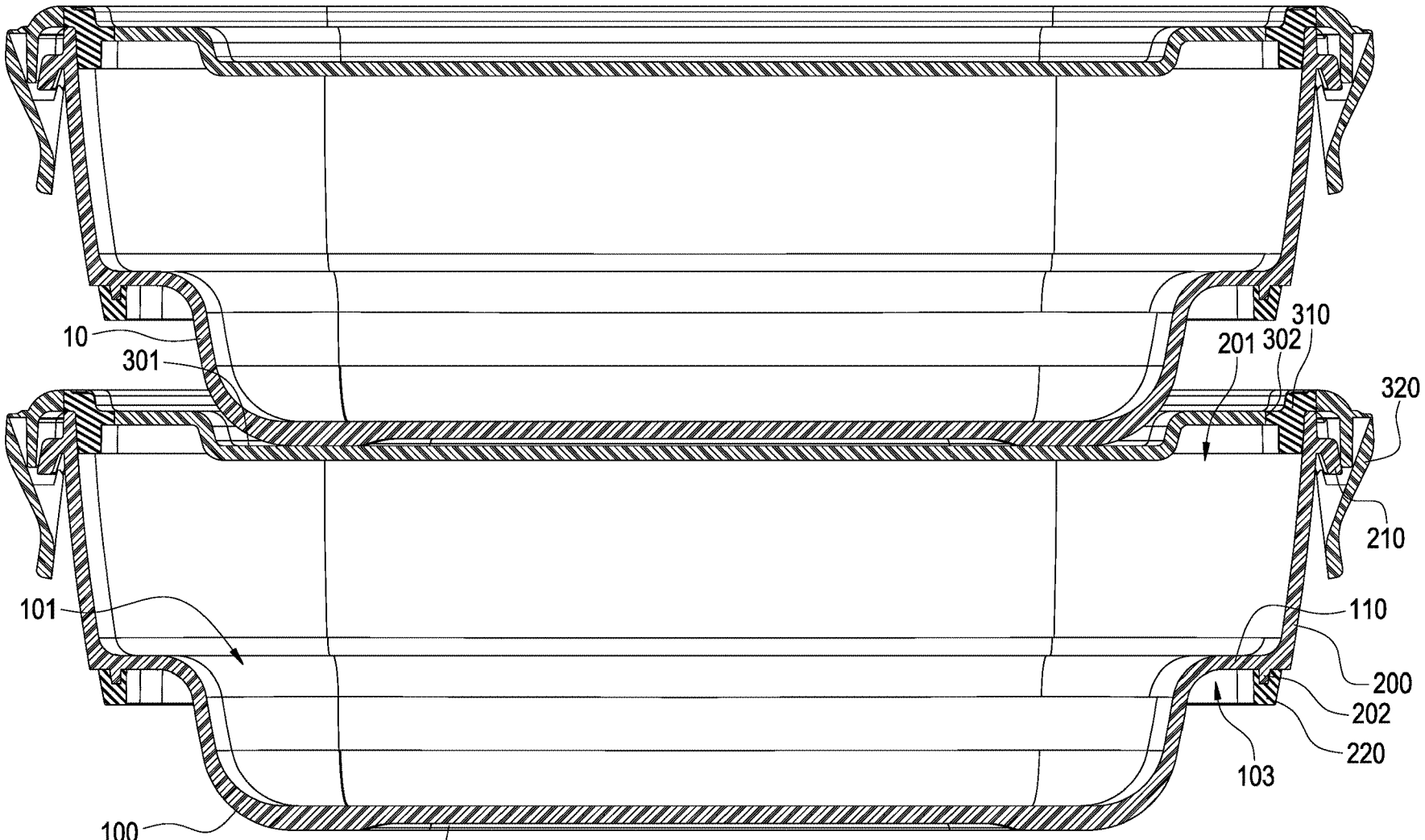
FIG. 7 is a schematic view showing the stacked heat insulating containers according to the preferred embodiment of the present disclosure.

According to FIG. 7, preferably, a positioning recess 301 could be selectively defined on an external surface of the lid 300, the positioning recess 301 is shaped corresponding to the external bottom surface of the bottom box 100, when multiple heat insulating containers according to the present disclosure are arranged in a stack, another bottom box 10 of another heat insulating container could be accommodated in the positioning recess 301.

Figure 8:
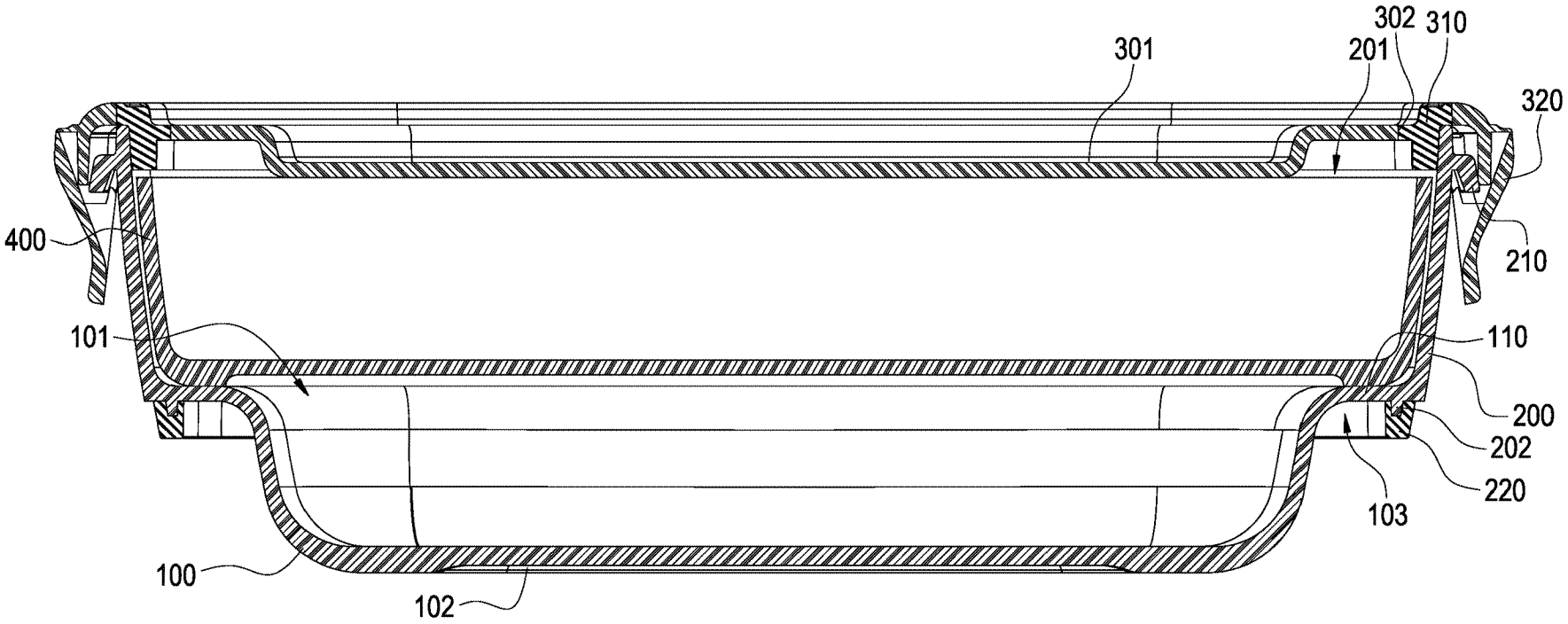
FIGS. 8 to 11 are schematic views showing various types of the nested heat insulating containers according to the preferred embodiment of the present disclosure.

According to FIG. 8, an inner box 400 could be selectively accommodated in the surrounding wall 200, and the inner box 400 is stacked on the flange 110 of the bottom box 100. Thereby, the inner space of the heat insulating container could be separated, and different foods could be respectively accommodated in the inner box 400 and the bottom box 100.

According to the heat insulating container of the present disclosure, the surrounding wall 200 is insulated from the bottom box 100 by the flange 110, and the handle portion 202 and the bottom box 100 are arranged at interval, and the handle portion 202 is wrapped by the rubber strip 220. Thereby, the bottom box 100 is prevented from direct contacting with the user, and the heated heat insulating container could be immediately taken out of the microwave oven.

Figure 9:
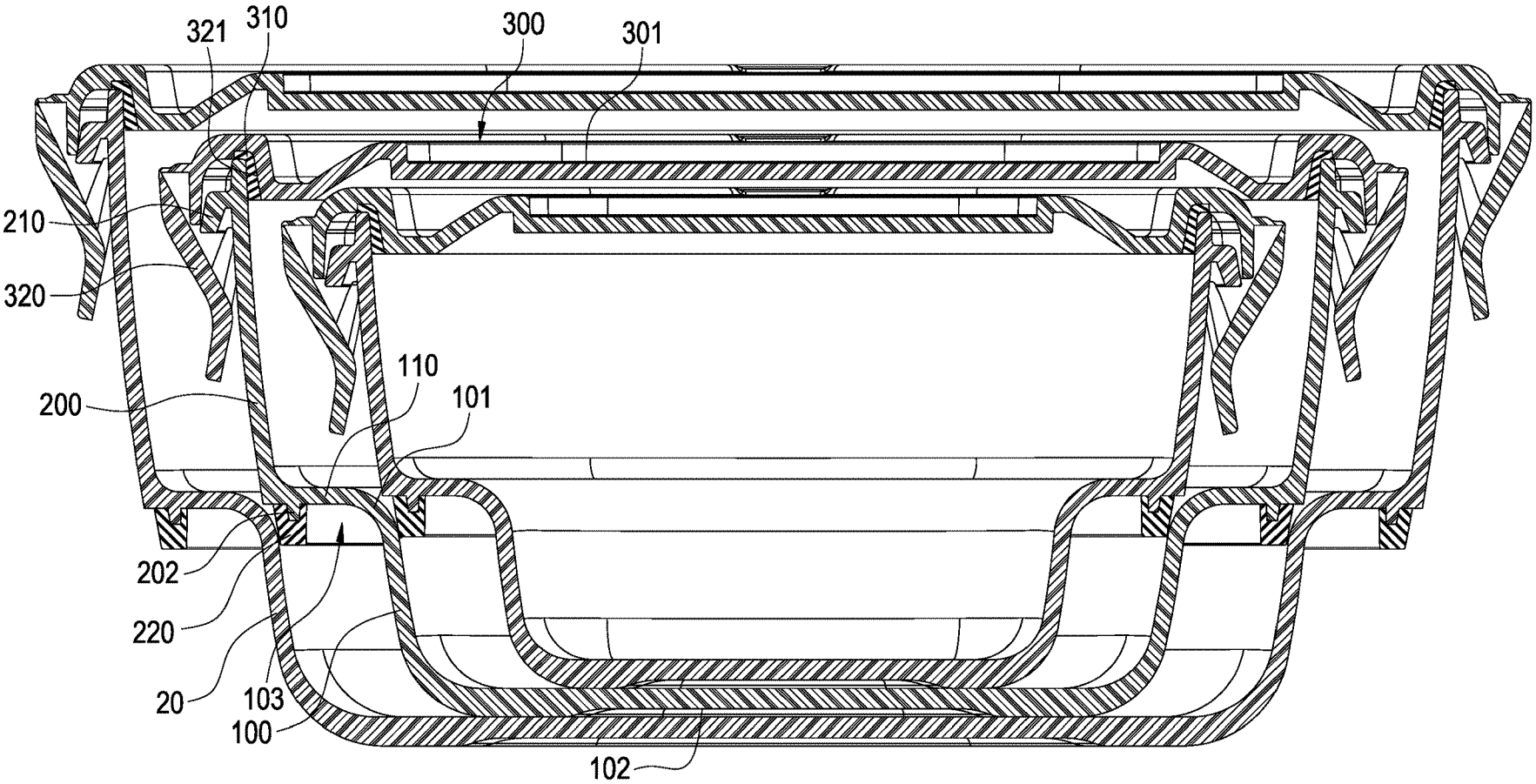
Figure 10:
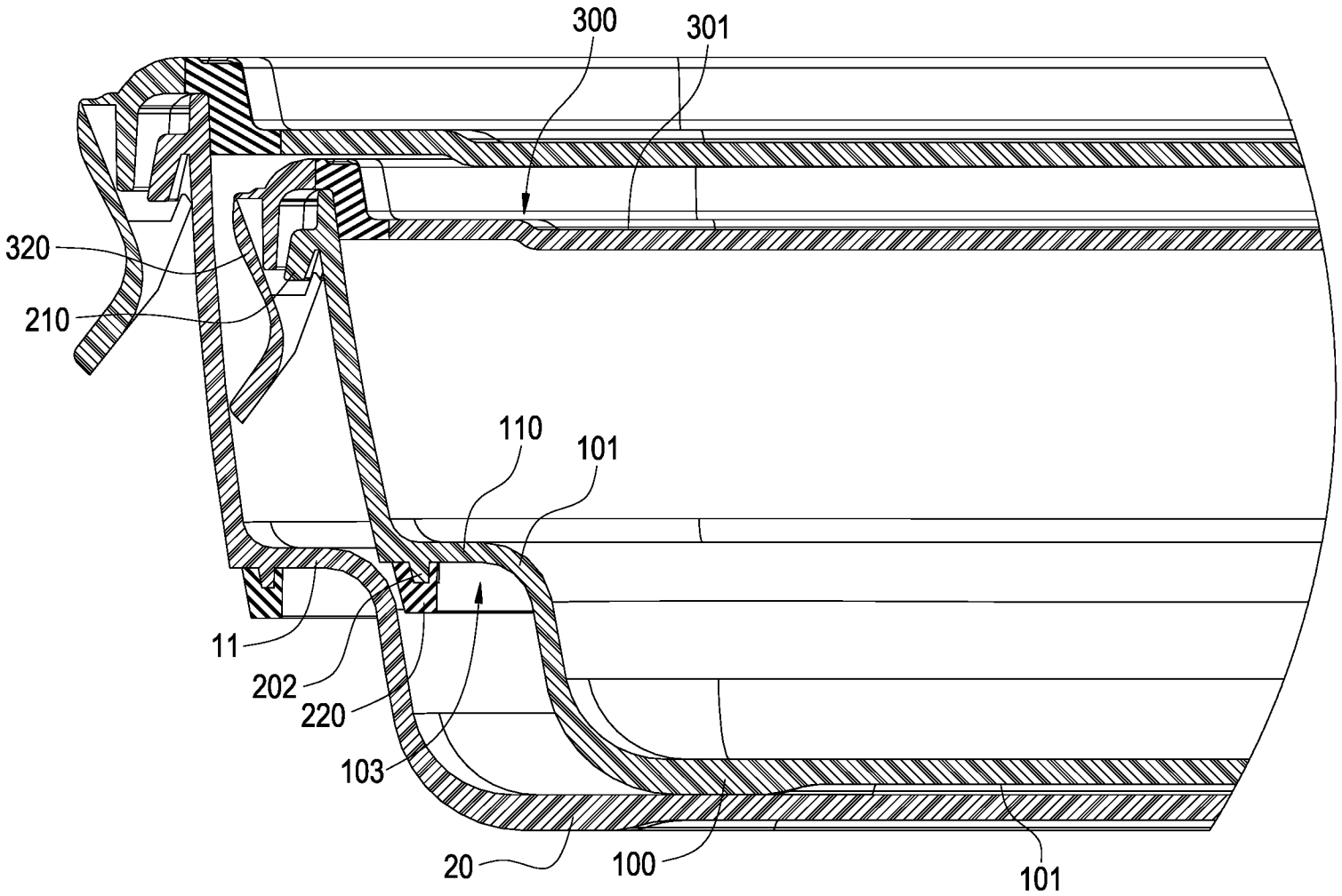
Figure 11:
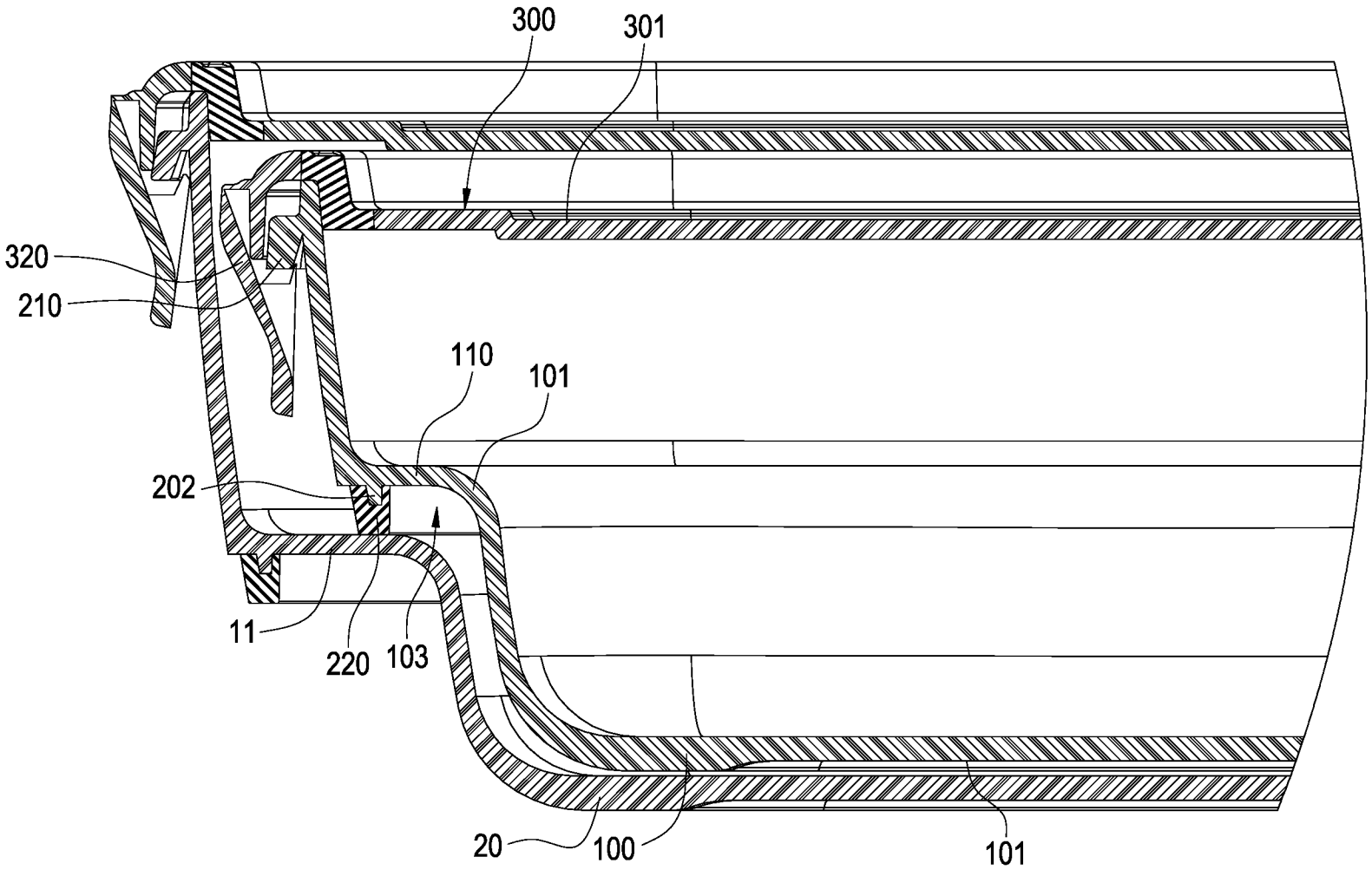

According to FIGS. 9 to 11, multiple heat insulating containers of the present disclosure with various sizes could be nested with each other. The nested heat insulating containers could be fixed with each other by various structures. According to FIG. 9, The bottom box 100 of the accommodated heat insulating container is stacked on an internal bottom of the bottom box 20 outside thereof, the handle portion 202 of the accommodated heat insulating container presses on an internal surface of the bottom box 20 outside thereof, and the heat insulating containers are thereby prevented from relative shifting. According to FIG. 10, the bottom box 100 of the accommodated heat insulating container stacked on the internal surface of the bottom box 20 outside thereof, the latch 320 of the lid 300 of the accommodated heat insulating container presses the internal surface of the surrounding wall 30 outside thereof, and the heat insulating containers are thereby prevented from relative shift. According to FIG. 11, the handle portion 202 of the accommodated heat insulating container supports on the flange 11 of the heat insulating container outside thereof, and the bottom box 100/20 nested with each other are thereby separated from each other.

Figure 12:
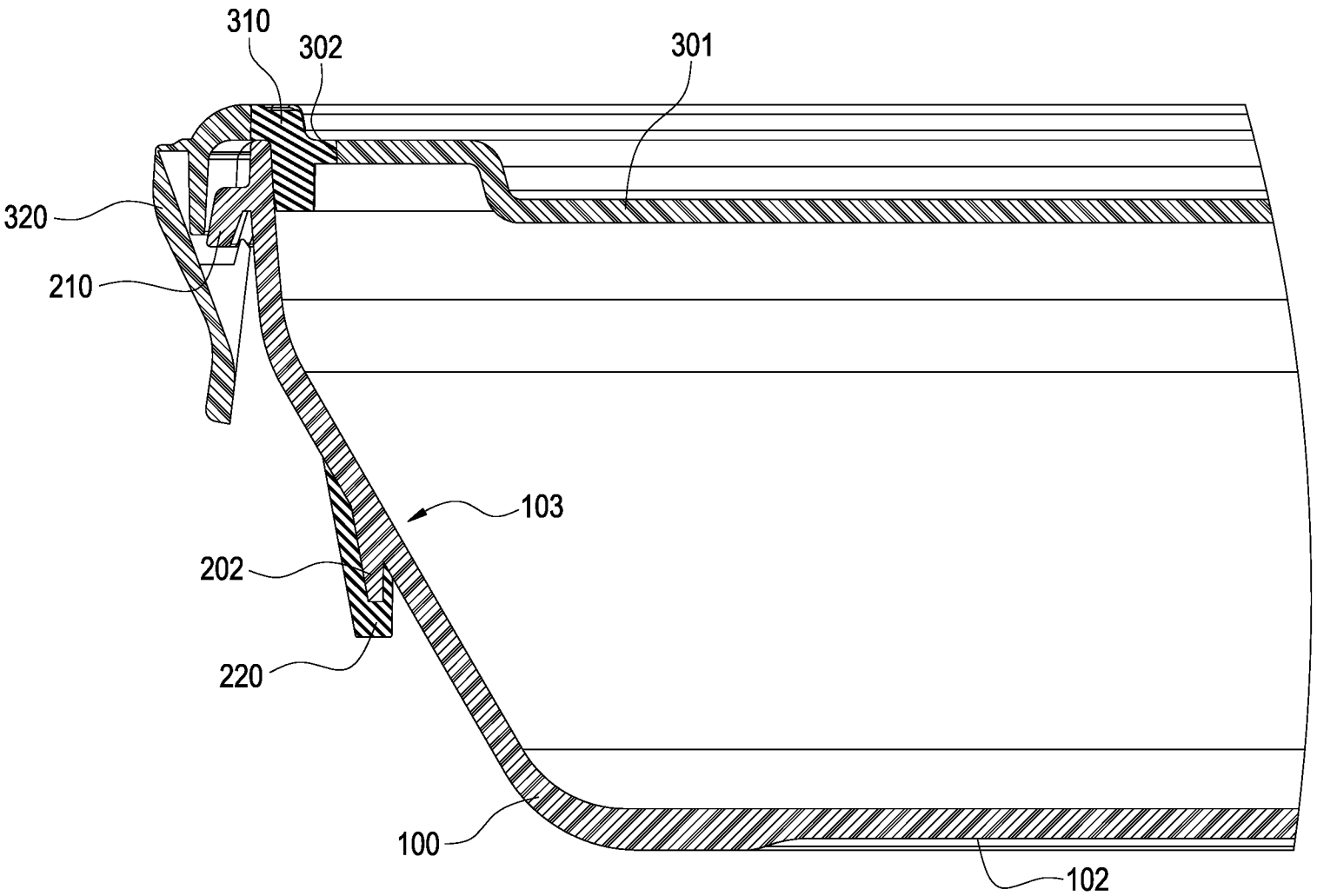
FIG. 12 is a schematic view showing alternative type of the junction between the bottom box and the surrounding wall of the heat insulating container.

The junction 103 between the bottom box 100 and the surrounding wall 200 of the present disclosure should not be limited to be the aforementioned flange 110. Alternatively, the bottom box 100 and the surrounding wall 200 could be smoothly connected at the junction 103 as shown in FIG. 12.

According to the heat insulating container of the embodiment of the present application, the handle portion of the surrounding wall and the bottom box are arranged at interval, and a space barrier is thereby defined therebetween to prevent the bottom box from direct contacting with the user and scald is therefore avoided. Accordingly, the present disclosure can be applied in industries.

Although the present disclosure has been described with reference to the foregoing preferred embodiment, it will be understood that the disclosure is not limited to the details thereof. Various equivalent variations and modifications can still occur to those skilled in this art in view of the teachings of the present disclosure. Thus, all such variations and equivalent modifications are also embraced within the scope of the present disclosure as defined in the appended claims.

What is claimed is:

1. A heat insulating container comprising: a bottom box and a surrounding wall surrounding the bottom box, a top portion of the bottom box being open and connected with the surrounding wall, an inner space of the surrounding wall being connected with an inner space of the bottom box, an opening being defined by a top edge of the surrounding wall, a handle portion is downward extended from an external surface of a junction between the bottom box and the surrounding wall, the handle portion and the bottom box being arranged at interval, and a rubber strip being arranged wrapping the handle portion, wherein a flange is outward protruded from the top portion of the bottom box, both inside and outside of the flange are outward protruded from the top portion of the bottom box, and an external edge of the flange is connected with and internal surface of the surrounding wall, so that the flange forms a junction between the bottom box and the surrounding wall, and the surrounding wall is insulated from an inner space of the bottom box by the flange.

2. The heat insulating container according to claim 1, wherein a lid covers on the opening, a sealing rubber strip is arranged on the lid, and the sealing rubber strip is clamped between the lid and the surrounding wall and the opening is thereby sealed.

3. The heat insulating container according to claim 2, wherein a positioning recess is defined on an external surface of the lid, the positioning recess is shaped corresponding to an external bottom surface of the bottom box for accommodating another bottom box.

4. The heat insulating container according to claim 2, wherein an annular groove is defined on a surface of the lid and a through hole is defined on the lid, the through hole is connected with the annular groove, the sealing rubber strip is embedded in the annular groove and a portion of the sealing rubber strip is embedded in the through hole.

5. The heat insulating container according to claim 2, wherein a plurality of snap-fits is arranged on an edge of the lid, the respective snap-fits buckle on an external surface of the surrounding wall.

6. The heat insulating container according to claim 5, wherein at least one barb for buckling with the snap-fits is arranged on the external surface of the surrounding wall.

7. The heat insulating container according to claim 6, wherein the barb is extended to surround the opening.

8. The heat insulating container according to claim 1, wherein a recess is formed on an external bottom surface of the bottom box.

9. The heat insulating container according to claim 1, wherein an inner box is accommodated in the surrounding wall and the inner box is stacked on the flange of the bottom box.

10. The heat insulating container according to claim 1, wherein the handle portion is extended from a lower edge of the surrounding wall.

* * * * *